United States Patent [19]

Colborne

[11] Patent Number: 4,659,086

[45] Date of Patent: Apr. 21, 1987

[54] BOARD GAME APPARATUS

[76] Inventor: Martin J. Colborne, 92B Sutherland Avenue, Biggin Hill, Kent, England, TN16 3HG

[21] Appl. No.: 723,958

[22] PCT Filed: Aug. 9, 1984

[86] PCT No.: PCT/GB84/00277

§ 371 Date: Apr. 8, 1985

§ 102(e) Date: Apr. 8, 1985

[87] PCT Pub. No.: WO85/00757

PCT Pub. Date: Feb. 28, 1985

[30] Foreign Application Priority Data

Aug. 9, 1983 [GB] United Kingdom ..... 8321388

[51] Int. Cl.[4] ..... A63F 3/00

[52] U.S. Cl. ..... 273/242; 273/288; 273/282; 273/287

[58] Field of Search ..... 273/288, 282 R, 282 C, 273/146, 153 S, 261, 242, 260; 434/403

[56] References Cited

U.S. PATENT DOCUMENTS 286,352 10/1883 Ward .

1,552,354 9/1925 Stanage ..... 273/261

2,199,719 5/1940 Brothers ..... 273/282 R 3,642,286 2/1972 Moore .

3,779,554 12/1973 Brix ..... 273/288 X 3,887,190 6/1975 Ameri ..... 273/288 X

FOREIGN PATENT DOCUMENTS 2520246 7/1983 France ..... 273/153 S

*Primary Examiner*—Richard C. Pinkham

*Assistant Examiner*—Matthew L. Schneider

*Attorney, Agent, or Firm*—Kane, Dalsimer, Sullivan, Kurucz, Levy, Eisele & Richard

[57] ABSTRACT

A game apparatus comprising at least one concave polyhedron playing piece and a game board. The concave polyhedron playing piece has a plurality of differently colored faces. Each of the faces comprises a plurality of similarly colored facets. The concave polyhedron also comprises a plurality of vertices that coincide with the vertices of a notional regular polyhedron. The game board is divided into a plurality of polygons such that each of the polygons corresponds in size and shape to the faces of the notional regular polyhedron. The game apparatus also includes a plurality of secondary playing pieces in the form of pyramids.

11 Claims, 3 Drawing Figures

BOARD GAME APPARATUS

Figure 1:
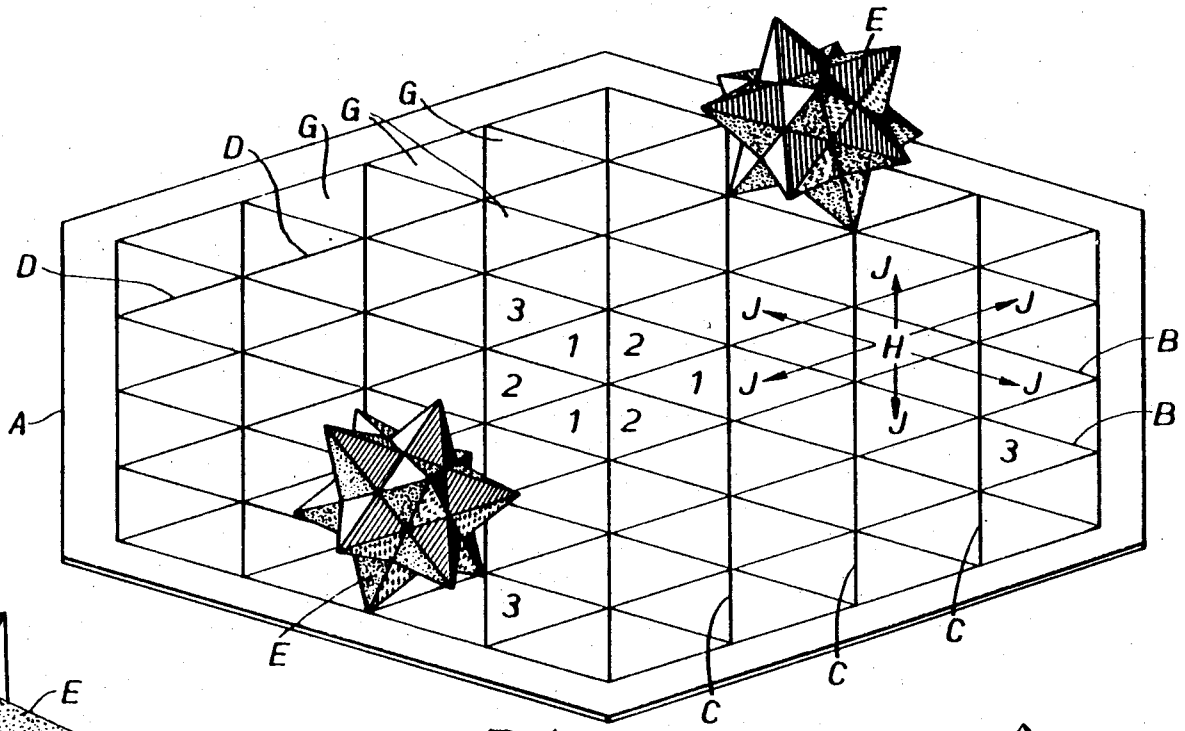

This invention relates to apparatus for playing a game.

The present invention provides apparatus for playing a game comprising a board and at least one piece that is a concave polyhedron and has a plurality of vertices that coincide with the vertices of a notional regular polyhedron the faces of which polyhedron are capable of tessellating a plane surface.

Although it would be possible to play a game using only one playing piece of the aforesaid form it is preferred if the apparatus comprises at least two of the said pieces to enable two or more players to play a game using the apparatus.

To ensure that the said playing pieces can sit on the board by virtue of three or more of the said vertices being in contact with the board and without any other contact between the playing piece and the board it is of advantage if the piece nowhere projects outside the volume bounded by the said notional polyhedron.

The board is preferably marked out with polygons adjoining one another side-to-side and at least some of the polygons on the board are of identical size and shape to the mirror images of respective ones of the faces of the said notional polyhedron, the polygons being so arranged on the board and the notional polyhedron being such that the piece can be rolled without slipping on the board with at least two vertices in contact with the board at all times in such a manner that whenever three or more vertices of the piece are in contact with the board a face of the notional polyhedron coincides with a polygon of the board.

The polygons of the board preferably form a repeating pattern.

Advantageously, the playing piece is a regular concave polyhedron. It may then be a great dodecahedron or a great icosahedron, but preferably it is a small stellated dodecahedron as hereinafter defined.

Throughout this Specification the term "small stellated dodecahedron" denotes the concave polyhedron commonly known as such and reputed first to have been devised by Johann Kepler, which has twelve interpenetrating faces each in the form of a pentagram, and twenty vertices each in the form of a pentagonal pyramid, and the edges of which are the diagonals of a notional convex icosahedron, other than those diagonals which, when the icosahedron is regular, are diameters of a notional circumscribed sphere.

The arrangement may be such that when the piece is rolled on a tessellated board in accordance with the invention not all of the faces of the notional polyhedron can coincide with polygons of the board, or not all of the polygons can coincide with faces of the notional polyhedron, or both.

Advantageously, each of the playing pieces is provided with a plurality of facets having distinctive identifiable characteristics. The identifiable characteristics may be in the form of markings such as symbols or numbers but preferably they are provided by areas of selected colours. It is particularly preferred if each of the facets is a different colour. If the playing piece is in the form of a regular concave polyhedron such as a small stellated dodecahedron then each of the said facets is preferably a face of the polyhedron.

If the board is marked out as a tessellation of the said faces of the notional polyhedron, the playing piece can sit on the board with each of its vertices in contact with the board being arranged at a respective vertex of one of the tessellae—which may, for example, be in the form of a triangle—on the board. To prevent movement or disturbance of the playing piece when positioned on the board it is preferred if the vertices of the tessallae are provided with a recess or hole for receiving a vertex of the playing piece. If the notional polyhedron is a regular polyhedron, the board is preferably marked out with the corresponding regular tessellation.

Because some of the faces of the playing piece, when in position on the board, will be obscured from view it is preferred if the playing board has a mirrored surface.

The apparatus may include other playing pieces ("secondary pieces") different from the aforesaid playing piece or playing pieces. Each of the secondary playing pieces is preferably in the form of a marker for playing on the board, preferably on each tessella on the board, and may take virtually any form but it is preferred if it is in the form of a pyramid or prism. For example, if each tessella is in the form of a triangle it is preferred if each of the secondary playing pieces is in the form of a triangular prism the end faces of which are congruent with each tessalla or if the secondary playing piece is in the form of a tetrahedral pyramid each face of which is congruent with each tessella on the board.

Although other means can be used to distinguish one player's secondary pieces from another player's secondary pieces it is preferred if each player has differently shaped secondary playing pieces.

Figure 3:
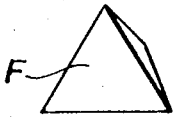
Figure 2:
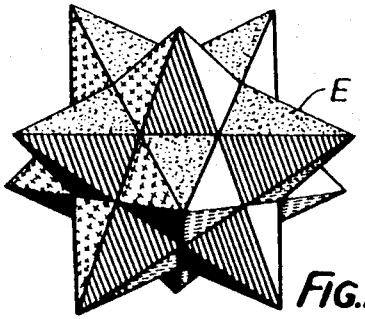

Board game apparatus constructed in accordance with the present invention will now be described, by way of example only, with reference to the accompanying drawings, in which:

FIG. 1 is a perspective view of a playing board on which two playing pieces of one kind are shown in place, FIG. 2 is an enlarged perspective view of one of the playing pieces shown in FIG. 1, and FIG. 3 is a perspective view of a second kind of playing piece.

Referring to the accompanying drawings and first of all to FIG. 1, the board game apparatus comprises a playing board A which is marked out with a uniform regular triangular grid and which has an outer perimeter of hexagonal form.

The triangular grid is formed by three sets of equispaced parallel lines B, C and D, each of those sets lying between and parallel to two parallel edges of the board.

Two playing pieces E are shown in position on the board and each is in the form of a small stellated dodecahedron. Each of the pentagram-shaped faces of the dodecahedron is provided with an identifiable characteristic. As shown in FIGS. 1 and 2 the identifiable characteristic is provided by colouring each of those faces, every face having a different colour. As can be seen from FIG. 2, each of the pentagram-shaped faces of the concave polyhedron comprises five triangular-shaped facets.

The apparatus also includes playing pieces F (see FIG. 3) of a second kind. As shown in FIG. 3 each of those playing pieces is in the form of a tetrahedral pyramid.

The length of any side of the triangles G on the board is equal to the distance between two neighbouring vertices of each dodecahedron. As a consequence each dodecahedron can be placed on the board with three of its vertices in contact with the board, each vertex being arranged at a respective vertex of a given triangle G on the board. To prevent accidental movement or disturbance of the dodecahedron once it has been placed in this way on the board each vertex of each triangle is preferably provided with a recess or hole (not shown) for receiving a vertex of the dodecahedron.

It will be evident from FIG. 1 that when a dodecahedron has been placed on the board some of its faces will be at least partially obscured from view and it is preferred therefore if the surface of the board is mirrored so that those surfaces of the dodecahedron can be viewed.

Each of the tetrahedral pyramids F has a respective identifiable characteristic corresponding to the identifiable characteristic of one of the pentagram shaped faces of the dodecahedron. Thus, for example, in the case of the coloured pentagram-shaped faces as shown in FIGS. 1 and 2 each tetrahedral pyramid will have a colour corresponding to one of the coloured faces of the dodecahedron. Thus, because each dodecahedron has twelve differently coloured faces twelve differently coloured tetrahedral pyramids F are provided for each dodecahedron employed in the apparatus.

Each of the triangular faces of the tetrahedral pyramid F is congruent with each of the triangles G marked on the board and can, therefore, be placed on the board so that one of its faces covers a triangle on the board.

A typical game employing the apparatus described and illustrated above is as follows:

The objective of the game, which in this example is for two players, is for each player to attempt to position any three of his pyramids F in a winning configuration in the central hexagon of the board. Thus, for example, as shown in FIG. 1 a player can win the game by arranging three of his pyramids F in the triangles marked 1 or in the triangles marked 2.

To start the game both dodecahedra E are placed on the board in the position shown in FIG. 1. At the commencement of the game no other pieces are on the board.

Each dodecahedron E has two main functions: first to launch its corresponding pyramids F and secondly, to attack the opponents dodecahedron and/or its corresponding pyramids.

Launching of the pyramids is achieved in the following way. When the dodecahedron has been placed on the board as shown in FIG. 1 or moved to another position on the board (in a way described later) then three planes, each including one of the coloured pentagram-shaped faces will each include a respective side of the triangle G on the board on which the dodecahedron stands, with its respective pentagram-shaped face outwards. Each of those three faces is deemed to be an "in-play" face at any time during the game and one or more of the pyramids associated with that dodecahedron and having a colour corresponding to one of the in-play faces may be then positioned adjacent to the face of the same colour on the neighbouring triangle on the board.

Each dodecahedron may attack the opponent's dodecahedron by matching the colour of one of the other dodecahedron's in-play faces with its own so that the side of the triangle on the board in the plane of that face lies between the same pair of neighbouring parallel lines B, C or D as the side of the triangle contained by the plane of the face of the same colour of the opponent's dodecahedron. That is to say, one dodecahedron may attack the other if one of its in-play faces is the same colour as one of the in-play faces of the other dodecahedron and if those faces face each other along a common row on the board defined by two neighbouring parallel lines B, C or D. The attack can be made irrespective of the distance between the two dodecahedra, it only being essential that the in-play faces of those dodecahedra must lie within a neighbouring pair of parallel lines on the board.

After a successful attack as described above the attacker can claim the opponent's matching colour pyramid, that is to say the pyramid of the colour corresponding to the facing in-play faces of the two dodecahedra, whether that pyramid is actually on the board or not. If a successful second attack is made using the same in-play coloured face then the attacker can claim a pyramid (of his opponent's) of his choice. Each dodecahedron may also attack a pyramid by moving an appropriate in-play face adjacent to the triangle in which an opponent's pyramid stands. That pyramid is then removed from the board. The opponent's dodecahedron cannot now, of course, use that corresponding coloured face as a launching face since that pyramid is now out of play.

A player may attack an opponent's pyramid of any colour by moving two of his pyramids adjacent to a triangle on the board on which the opponent's pyramid is standing. If the opponent's pyramid does not have a supporting pyramid (that is to say, another pyramid standing on a neighbouring triangle) the opponent's pyramid can then be captured and removed from the board.

Instead of using two pyramids to capture an opponent's pyramid, one pyramid and an appropriate in-play face of a dodecahedron can be arranged adjacent to the triangle in which the opponent's pyramid is standing to capture that pyramid.

The dodecahedron can also be used instead of a pyramid to support any of the pyramids belonging to a player having that dodecahedron.

If a player can launch or move three pyramids of any colour into the corners of a larger triangle formed by a group of triangles he can then remove all the opponent's pyramids that lie within that larger triangle. The corners of such a larger triangle are identified by the numbers 3 in FIG. 1. The larger triangle may in fact be of a different size to that illustrated, the smallest possible containing four neighbouring triangles on the board.

Both the dodecahedra and the pyramids may be moved on the board in various ways. For example each dodecahedron can be moved as follows. First it can be moved effectively in a straight line between a respective pair of lines B, C or D on the board. Each dodecahedron can be moved in any one of six directions in a straight line those directions being defined by a pair of neighbouring parallel lines B, C or D which are spanned by any one of the three sides of the triangle on the board on which the dodecahedron is positioned. As shown in FIG. 1 for example, if the dodecahedron is placed on the triangle H it can be moved in any one of the six directions indicated by the arrows J. That is to say, each in play face provides two possible straight line movements of the dodecahedron. The dodecahedron is effectively "rolled" in that direction by keeping two of the in contact vertices on the board lifting the other vertex from the board and rolling the dodecahedron until the adjacent vertex on the other side of the two that have been kept in contact with the board contacts the third vertex of a neighbouring triangle.

Each dodecahedron can also be rolled in a circular movement from triangle to triangle in an array of six neighbouring triangles on the board forming a hexagon.

Each of the pyramids may be moved one triangle at a time in any direction between a pair of neighbouring parallel lines B, C or D on the board.

Neither the dodecahedron nor the pyramids can be moved into or cross over any triangle occupied by the opponent's pyramid or dodecahedron.

Each dodecahedron can be moved any number of triangles in a straight line along a row defined by a pair of neighbouring parallel lines B, C or D and, as mentioned previously, the dodecahedron may be moved to complete a circle of six triangles so that it returns to its starting triangle. In that case although the dodecahedron returns to the same position its pentagram-shaped faces will be re-orientated.

During play each player may move in his turn either the dodecahedron, in the way described above, and then launch one or more pyramids or attack his opponent's dodecahedron or pyramids. Alternatively he may move one or all of his pyramids on the board one triangle and attack his opponent's pyramids.

The above described game is just one example of how the apparatus may be used. The game described is an intermediate to fairly complex version and it will be appreciated that many different games can be played which could be either more simple, which would enable children to play, or more complex.

The polyhedra and the pyramids may be made from virtually any suitable material such as card or metal but it is preferred if they are made from plastics materials.

Further the material of the board can be metal, wood, glass, heavy card, plastics or any other suitable sheet material.

The selection of the material for the playing pieces and the board can be such that there is sufficient frictional contact between them during play that the holes or recess at the vertices of each triangle, referred to above, could be omitted. It is also possible to arrange for the pieces to be magnetically attracted to the board. Alternatively the vertices of the dodecahedron may be made of a special non-slip material and/or the board may be made of such material.

It is not essential for the board to have a mirrored surface because when one becomes familiar with the game one will readily be able to determine which of the faces are obscured from view.

Polyhedra are preferred for use as the playing pieces of the second kind, for example, a pentahedral pyramid may be used, but they may also be in the form of prisms, for example, a triangular or pentagonal prism although any playing piece which can be used as a marker on the board will suffice.

It is not essential for the outer perimeter of the board to be hexagonal in form and it could be shaped in other ways, for example, it could be in the form of a six-pointed star or in the form of a triangle.

It is not essential, either, for the faces of the dodecahedra to be identified by colour. Other identifiable characteristics may be provided on each of the pentagram-shaped faces for example, by different markings such as numbers, symbols etc.

In the game described above each player is provided with one dodecahedron and with a set of twelve pyramids as shown in FIG. 3 each of those pyramids having a colour corresponding to a colour of a respective face of the dodecahedron. It is envisaged that three or more players can use the apparatus and in that case each player would then be provided with a dodecahedron and a suitable number of playing pieces of the second kind. To avoid confusion between each player's playing pieces of the second kind each player may be provided with differently shaped pieces of that kind. A game of patience using only one dodecahedron is also a possibility.

I claim:

1. Apparatus for playing a game, comprising at least one piece that is a concave polyhedron and has a plurality of vertices that coincide with the vertices of a notional regular polyhedron the faces of which notional polyhedron are capable of tessellating a plane surface, and a board which is marked out with polygons and adjoining one another side-to-side at least some of the polygons on the board being of identical size and shape to the mirror images of respective ones of the faces of the said notional polyhedron, the polygons being so arranged on the board and the notional polyhedron being such that the piece can be rolled without slipping on the board with at least two vertices in contact with the board at all times in such a manner that whenever three or more vertices of the piece are in contact with the board a face of the notional polyhedron coincides with a polygon of the board.

2. Apparatus as claimed in claim 1, wherein the piece is a small stellated dodecahedron has hereinbefore defined.

3. Apparatus as claimed in claim 1, in which the piece is provided with a plurality of facets having distinctive identifiable characteristics.

4. Apparatus as claimed in claim 3, wherein the identifiable characteristics are provided by areas of selected colours.

5. Apparatus as claimed in claim 4, wherein said concave polyhedron comprises a plurality of faces, each face being defined by a plurality of said facets and wherein each said face is a different colour.

6. Apparatus as claimed in claim 1, wherein the polygons of the board form a repeating pattern.

7. Apparatus as claimed in claim 1, wherein the board is marked out as a tessellation of the said faces of the notionol polyhedron.

8. Apparatus as claimed in claim 7, in which each tessella is in the form of a triangle.

9. Apparatus as claimed in claim 7, in which each vertex of each tessella is provided with a hole for receiving a vertex of the playing piece.

10. Apparatus as claimed in claim 1, in which the playing board has a mirrored surface.

11. Apparatus as claimed in claim 1, in which the apparatus includes other playing pieces different from the aforesaid playing piece.

* * * * *